US006565093B2

(12) United States Patent
Crow et al.

(10) Patent No.: US 6,565,093 B2
(45) Date of Patent: May 20, 2003

(54) SEAL STRUCTURE FOR DOWNHOLE TOOL

(75) Inventors: Stephen L. Crow, Coppell, TX (US); William D. Henderson, Tioga, TX (US); Timothy E. Harms, The Colony, TX (US); Robert W. Crow, Irving, TX (US); Ralph Jones, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 37 days.

(21) Appl. No.: 09/797,508

(22) Filed: Mar. 1, 2001

(65) Prior Publication Data

US 2002/0121743 A1 Sep. 5, 2002

(51) Int. Cl.[7] ..... E21B 33/128

(52) U.S. Cl. ..... 277/337; 277/338; 277/616; 277/626

(58) Field of Search ..... 277/336–343, 277/438, 459, 460, 435, 437, 575, 518, 584, 585, 616, 626

(56) References Cited

U.S. PATENT DOCUMENTS 1,283,091 A * 10/1918 Crawford
1,378,894 A * 5/1921 Norman
1,658,440 A * 2/1928 Hanigan
2,912,292 A * 11/1959 Lawitschka
2,991,137 A * 7/1961 Daye
3,179,093 A * 4/1965 Sims et al.
3,416,608 A * 12/1968 Crow et al.
3,921,988 A * 11/1975 Prasse et al.
4,106,779 A * 8/1978 Zabcik
4,174,112 A * 11/1979 Carrens
5,584,488 A * 12/1996 Lembcke
6,203,020 B1 * 3/2001 Mireles, Jr. et al.
6,305,695 B1 * 10/2001 Wilson

OTHER PUBLICATIONS

Otis Engineering Corporation Drawing No. 91 M 849.
Halliburton Energy Services Drawing No. 91 M 3479.

* cited by examiner

*Primary Examiner*—Anthony Knight
*Assistant Examiner*—Alison K. Pizkard
(74) *Attorney, Agent, or Firm*—Marlin Smith

(57) ABSTRACT

A seal structure is provided for a downhole tool. In a described embodiment, a seal structure includes a seal support ring having at least one annular groove formed thereon and a longitudinal axis. At least one seal is included in the seal structure. The seal is disposed at least partially in the groove, and the seal is bonded to the ring. An annular recess is positioned longitudinally between opposing side walls of the groove. The recess may be formed in a body of the seal.

17 Claims, 3 Drawing Sheets

SEAL STRUCTURE FOR DOWNHOLE TOOL

BACKGROUND

The present invention relates generally to sealing means for downhole tools and, in an embodiment described herein, more particularly provides a seal structure for a downhole tool.

It is well known that significant problems are typically encountered when an attempt is made to sealingly engage a seal bore in a downhole tool in an abrasive environment. Such an abrasive environment may exist, for example, in a fracturing or gravel packing job. These problems are multiplied when such sealing engagement must be performed multiple times downhole.

FIGS. 1A & B illustrate a representative example of such a situation. A prior art seal structure 10 is disposed externally on a mandrel 12 of a downhole tool. The seal structure 10 includes a seal support ring 14 and two seals 16 disposed in open-sided grooves 18 formed externally on the ring. The seals 16 are bonded to the ring 14 in the grooves 18.

It is desired to have the seal structure lo enter a seal bore 20 and effect a pressure bearing seal between the mandrel 12 and the seal bore. Unfortunately, sand 22, or another abrasive material, such as synthetic proppant, etc., has accumulated between the mandrel 12 and the seal bore 20. When the seal structure 10 enters the seal bore 20, the sand 22 is compressed between the seals 16 and the seal bore, as may be seen in FIG. 1B.

Compression of the sand 22 between the seals 16 and the seal bore 20 may not cause immediate failure of the seals. However, with repeated cycles of the seal structure 10 entering and withdrawing from the seal bore 20, the seals will eventually deteriorate.

This problem appears to be exacerbated where a relatively large degree of compression is experienced in the seals 16 when they enter the seal bore 20. Note that the seals 16 fill the grooves 18 and so, when the seals enter the smaller diameter seal bore 20, they are compressed inwardly against walls of the grooves, as well as being significantly compressed against the seal bore and the sand 22 between the seals and the seal bore. An improved seal structure should provide space for the seals to deflect inwardly when a seal bore is entered, so that compression of the seals against the seal bore is reduced.

Another problem experienced in these situations is high "stabbing" force. That is, the force which must be exerted against the seal structure 10 to urge it into the seal bore 20. In general, high stabbing forces are to be avoided, since they are known to cause seal damage, they may cause operational problems, etc. An improved seal structure should reduce the stabbing force needed for the seal structure to enter a seal bore.

SUMMARY

In carrying out the principles of the present invention, in accordance with an embodiment thereof, a seal structure is provided which solves the above problems in the art.

In one aspect of the invention, a seal structure for a downhole tool is provided which includes a seal support ring and a seal. The seal support ring has at least one annular groove formed thereon. The seal is disposed at least partially in the groove, the seal is bonded to the ring, and the seal has an annular recess formed thereon.

The recess may have a variety of cross-sectional shapes. In addition, the recess may be positioned in various portions of the seal body. Furthermore, there may be multiple seals disposed in multiple respective grooves on the ring.

In another aspect of the invention, another seal structure for a downhole tool is provided. The seal structure includes a seal support ring having at least one annular groove formed thereon and a longitudinal axis. A seal is disposed at least partially in the groove, and the seal is bonded to the ring. An annular recess is positioned longitudinally between opposing side walls of the groove.

Again, the recess may have a variety of cross-sectional shapes, the recess may be positioned in various portions of the seal body, and there may be multiple seals disposed in multiple respective grooves on the ring. In addition, the recess may be formed in a body of the seal.

In yet another aspect of the invention, another seal structure for a downhole tool is provided which includes a seal support ring, at least four seals and at least two recesses. The seal support ring has first, second, third and fourth spaced apart annular grooves formed on a surface thereof. First, second, third and fourth seals are bonded in respective ones of the first, second, third and fourth grooves, with the second and third seals being disposed between the first and fourth seals. A first annular recess is positioned between opposing side walls of the second groove, and a second recess is positioned between opposing side walls of the third groove.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 2:
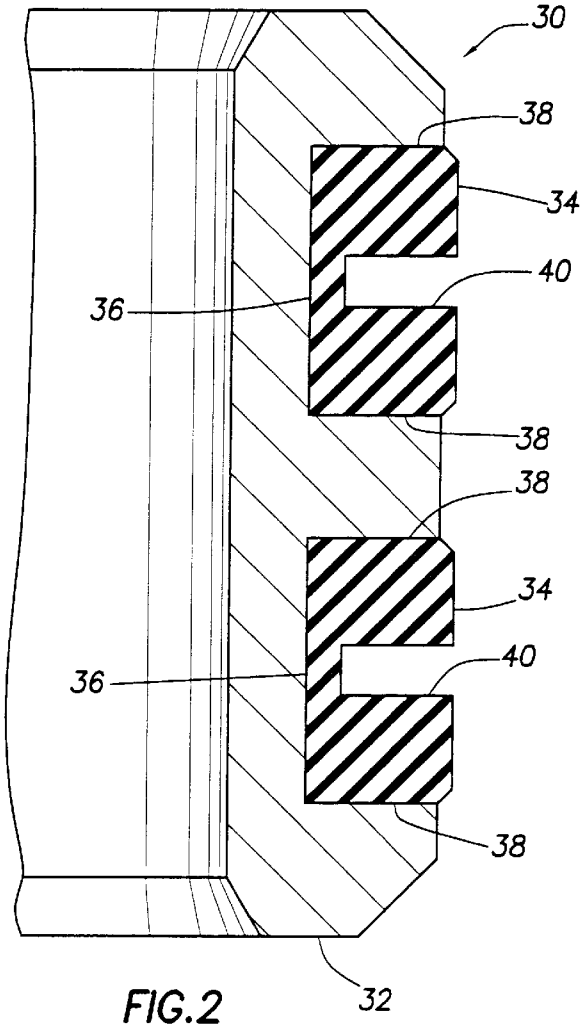
FIG. 2 is an enlarged scale quarter-sectional view of a first seal structure embodying principles of the present invention.

Representatively illustrated in FIG. 2 is a seal structure 30 which embodies principles of the present invention. In the following description of the seal structure 30 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The seal structure 30 includes a seal support ring 32 and two seals 34 disposed in annular grooves 36 formed externally on the ring 32. Of course, the seals 34 and grooves 36 could be internally formed on the ring 32, if desired for a particular application, such as for sealing engagement with a cylindrical member within the ring. The seals 34 are bonded to the ring 32 in the grooves 36.

Note that each of the seals 34 is positioned between opposing side walls 38 of the respective groove 36. Specifically, the side walls 38 are on longitudinally opposite sides of the each of the seals 34, relative to a longitudinal axis of the ring 32. Thus, the seals 34 are retained between the side walls 38 of the grooves 36.

A recess 40 is positioned between the side walls 38 of each of the grooves 36. The depicted recesses 40 are generally rectangular in cross-section and are formed in the bodies of the seals 34 approximately midway between the side walls 38 of each of the grooves 36. However, it is to be clearly understood that the recesses 40 may be otherwise shaped, may be otherwise positioned and may be formed in other components of the seal structure 30, without departing from the principles of the present invention.

It may now be appreciated that the recesses 40 provide space for the seals 34 to displace inwardly toward the grooves 36, without excessive compression of the seals. This reduced compression of the seals 34 reduces deterioration of the seals due to compressed abrasive material, and reduces the stabbing force needed for sealing engagement.

Figure 1B:
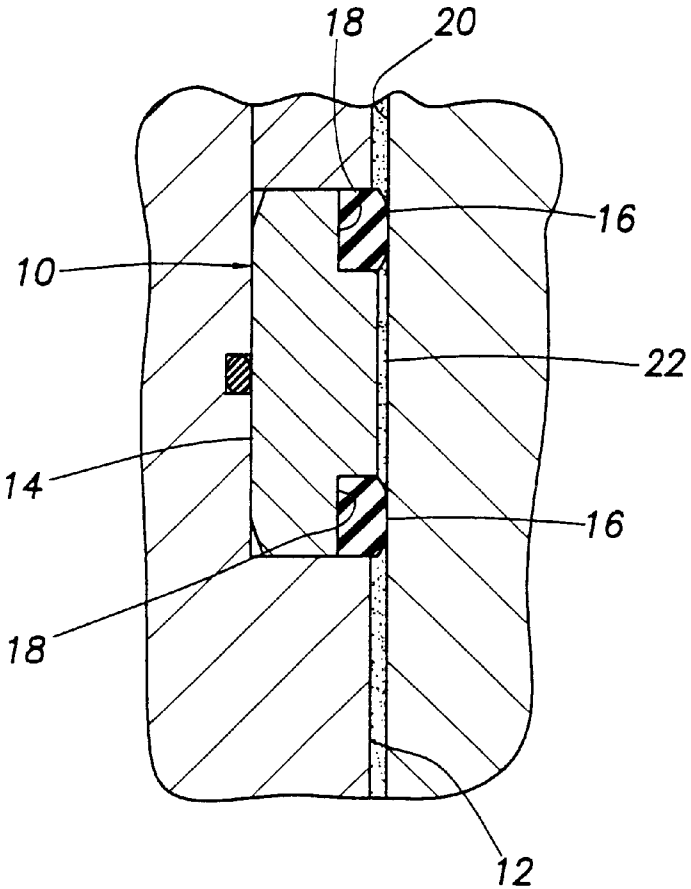
FIG. 1B (PRIOR ART)
FIGS. 1A & B are quarter-sectional views of a prior art seal structure for a downhole tool.
Figure 1A:
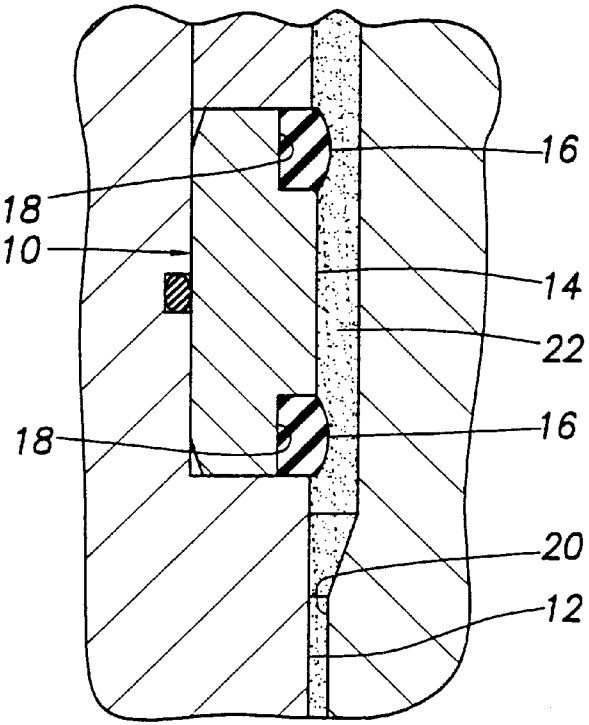
FIG. 1A (PRIOR ART)
Figure 3:
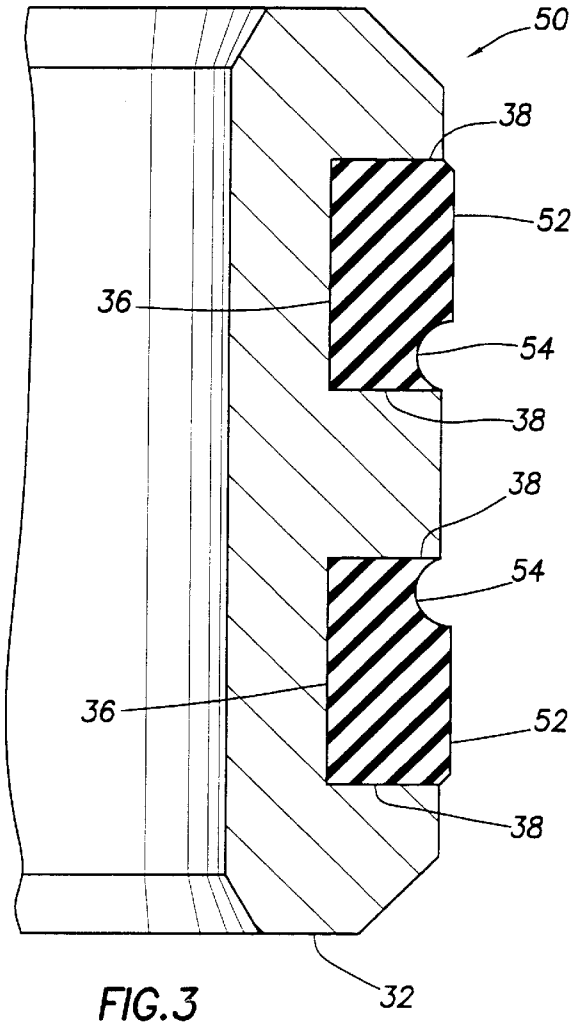
FIG. 3 is an enlarged scale quarter-sectional view of a second seal structure embodying principles of the present invention.

Referring additionally now to FIG. 3, another seal structure 50 embodying principles of the present invention is representatively illustrated. The seal structure 50 is similar in many respects to the seal structure 30 described above, and so elements of the seal structure 50 which are similar to those described above are indicated in FIG. 3 using the same reference numbers.

The seal structure 50 includes seals 52 disposed in the grooves 36 between respective ones of the side walls 38. The seals 52 are bonded to the ring 32 in the grooves 36. However, recesses 54 are formed in the seals 52 which differ substantially from the recesses 40 formed in the seals 34.

The recesses 54 are generally semi-circular in cross-section. Thus, the recesses 54 each have a concave radiused internal surface. In addition, the recesses 54 are each adjacent one of the side walls 38 of its respective groove 36, rather than being centrally positioned between the side walls.

Figure 4:
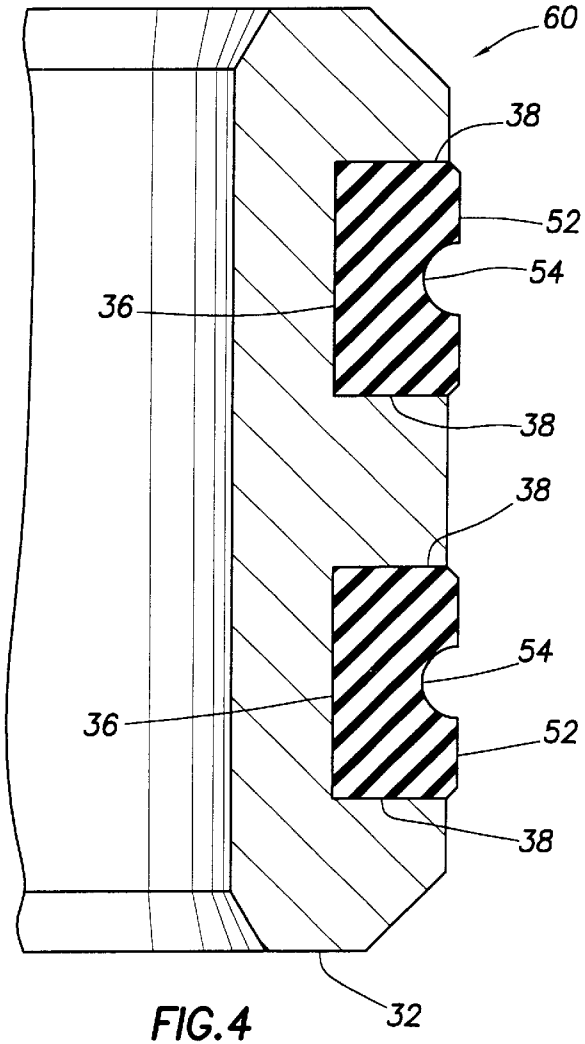
FIG. 4 is an enlarged scale quarter-sectional view of a third seal structure embodying principles of the present invention.

Referring additionally now to FIG. 4, another seal structure 60 embodying principles of the present invention is representatively illustrated. The seal structure 60 is similar in many respects to the seal structure 50 described above, and so elements of the seal structure 60 which are similar to those described above are indicated in FIG. 4 using the same reference numbers.

In the seal structure 60, the radiused recesses 54 are positioned in the bodies of the seals 52 approximately midway between side walls 38 of the respective grooves 36. Otherwise, the seal structure 60 is the same as the seal structure 50. However, due to the different positioning of the recesses 54, the seals 52 of the seal structure 60 may react differently to a pressure differential applied thereacross.

Figure 5:
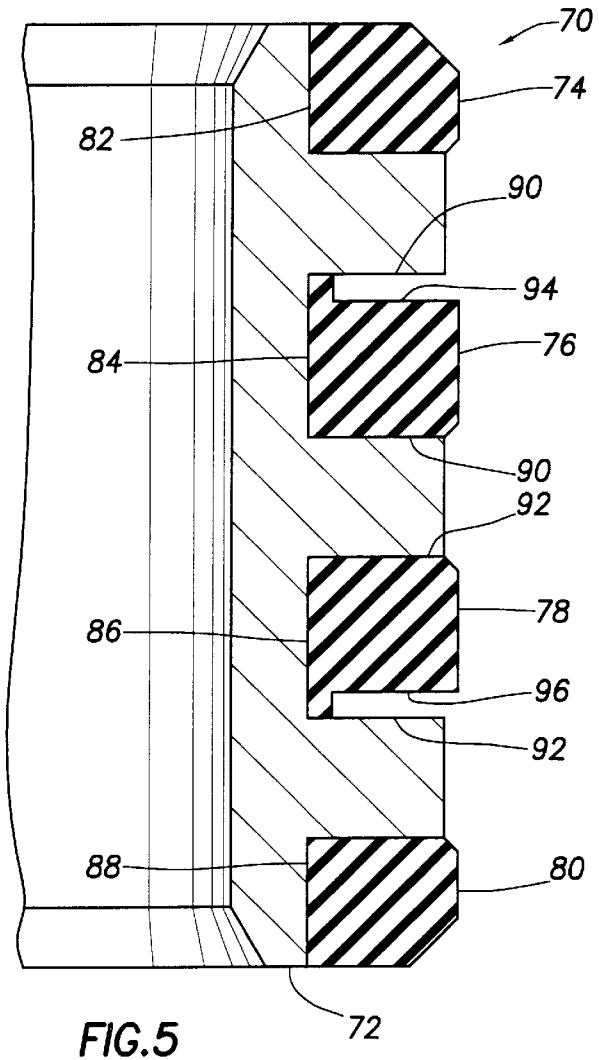
FIG. 5 is an enlarged scale quarter-sectional view of a fourth seal structure embodying principles of the present invention.

Referring additionally now to FIG. 5, another seal structure 70 embodying principles of the present invention is representatively illustrated. The seal structure 70 includes a seal support ring 72 and four seals 74, 76, 78, 80 disposed and bonded in four respective annular grooves 82, 84, 86, 88 formed externally on the ring. Of course, the seals 74, 76, 78, 80 and grooves 82, 84, 86, 88 could be internally disposed on the ring 72, in keeping with the principles of the present invention.

The outer seals 74, 80 may be configured as "wiper" rings. That is, the seals 74, 80 may be designed to wipe a seal surface free of abrasive material, debris, etc., before the inner seals 76, 78 contact the seal surface. Alternatively, or in addition, the outer seals 74, 80 may serve as initial seals for resisting a pressure differential, so that each of the inner seals 76, 78 resists the pressure differential after the respective one of the outer seals 74, 80 has failed.

Note that only the inner seals 76, 78 are positioned between opposing side walls 90, 92 of the respective inner grooves 84, 86. The outer grooves 82, 88 do not have opposing side walls.

An annular recess 94 is formed in a body of the seal 76, so that the recess 94 is positioned between the seal body and the upper side wall go of the groove 84. The recess 94 is generally rectangular in cross-section.

A similar annular recess 96 is formed in a body of the seal 78. However, the recess 96 is positioned between the seal 78 body and the lower side wall 92 of the groove 86. The difference in positionings of the grooves 94, 96 is due to the different directions in which a pressure differential will act on the seals 76, 78 in a preferred use of the seal structure 70. However, it is to be clearly understood that the recesses 94, 96 may be positioned other than as depicted in FIG. 5, without departing from the principles of the present invention.

Note that, in the seal structures 30, 50, 60, 70 described above, the seals 34, 52, 74, 76, 78, 80 may be formed of materials which are able to withstand high temperatures and otherwise hostile environments. One such hostile environment is use with heavy metal completion fluids, such as zinc bromide, and temperatures above 275° F.

For example, the outer seals 74, 80 of the seal structure 70 may be of a nitrile material and the inner seals 76, 78 may be formed of a fluorocarbon material (such as Fluorel™, Viton™, etc.). The nitrile material provides strength, so that the outer seals 74, 80 may act as wipers, as well as seals, and the fluorocarbon material provides enhanced chemical and temperature resistance.

The seal materials may be elastomers, they may be non-elastomeric, or a combination of these. Note that any seal material may be used, without departing from the principles of the present invention.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A seal structure for a downhole tool, the seal structure comprising:

a seal support ring having at least two annular grooves formed on an external surface thereof; and at least first and second seals, the first and second seals being disposed at least partially in the grooves, the first and second seals being bonded to the ring, and each of the first and second seals having an annular recess formed thereon, the annular recess being positioned in a body of the seal between and spaced inwardly from opposite sides of the seal body.

2. The seal structure according to claim 1, wherein the recess opens outwardly with respect to the groove.

3. The seal structure according to claim 1, wherein the recess is positioned in the first seal between opposing side walls of the groove.

4. The seal structure according to claim 1, wherein each annular recess has a generally rectangular cross-sectional shape.

5. The seal structure according to claim 1, wherein the recess has a generally semi-circular cross-sectional shape.

6. The seal structure according to claim 1, wherein the recess has a concave radiused internal surface portion.

7. The seal structure according to claim 1, wherein the second seal is configured to sealingly engage a seal bore prior to the first seal engaging the seal bore.

8. The seal structure according to claim 1, wherein the first seal seals against a pressure differential when the second seal has failed in the presence of the pressure differential.

9. A seal structure for a downhole tool, the seal structure comprising:

a seal support ring having at least one annular groove formed thereon and a longitudinal axis;

at least one seal, the seal being disposed at least partially in the groove, and the seal being bonded to the ring; and an annular recess positioned in a body of the seal adjacent a side of the seal body and an opposing side wall Of the groove, all seals carried by the seal support ring being external seals.

10. The seal structure according to claim 9, wherein the recess has a concave radiused surface portion.

11. The seal structure according to claim 9, wherein the recess has a generally semi-circular cross-sectional shape.

12. The seal structure according to claim 9, wherein the recess opens outwardly with respect to the groove.

13. The seal structure according to claim 9, wherein the annular recess has a generally rectangular cross-sectional shape.

14. A seal structure for a downhole tool, the seal structure comprising:

a seal support ring having first, second, third and fourth spaced apart annular grooves formed on a surface thereof;

first, second, third and fourth seals bonded in respective ones of the first, second, third and fourth grooves, the second and third seals being disposed between the first and fourth seals; and first and second annular recesses, the first annular recess being positioned between opposing side walls of the second groove, and the second recess being positioned between opposing side walls of the third groove, all seals carried by the seal supporting ring being external seals.

15. The seal structure according to claim 14, wherein the first and second recesses are formed in bodies of the second and third seal, respectively, and the first and second recesses being positioned on opposite longitudinal sides of the second and third seals.

16. A seal structure for a downhole tool, the seal structure comprising:

a seal support ring having first, second, third and fourth spaced apart annular grooves formed on a surface thereof;

first, second, third and fourth seals bonded in respective ones of the first, second, third and fourth grooves, the second and third seals being disposed between the first and fourth seals; and first and second annular recesses; the first annular recess being positioned between opposing side walls of the second groove, and the second recess being positioned between opposing side walls of the third groove, the second and third seals being formed of a different material than the first and fourth seals.

17. A seal structure for a downhole tool, the seal structure comprising:

a seal support ring having first, second, third and fourth spaced apart annular grooves formed on a surface thereof;

first, second, third and fourth seals bonded in respective ones of the first, second, third and fourth grooves, the second and third seals being disposed between the first and fourth seals; and first and second annular recesses, the first annular recess being positioned between opposing side walls of the second groove, and the second recess being positioned between opposing side walls of the third groove, the second and third seals being formed of a fluorocarbon material and the first and fourth seals being formed of a nitrile material.

* * * * *